US008373598B2

(12) United States Patent
Tsai et al.

(10) Patent No.: US 8,373,598 B2
(45) Date of Patent: Feb. 12, 2013

(54) ANTENNA DEVICE AND DUAL-BAND ANTENNA

(75) Inventors: Tiao-Hsing Tsai, Yunghe (TW); Chieh-Ping Chiu, Erlun Township, Yunlin County (TW); I-Ping Yen, Yonghe (TW); Feng-Jen Weng, Tao Yuan Shien (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 448 days.

(21) Appl. No.: 12/709,785

(22) Filed: Feb. 22, 2010

(65) Prior Publication Data

US 2011/0084889 A1 Apr. 14, 2011

(30) Foreign Application Priority Data

Oct. 8, 2009 (TW) ..... 98134112 A

(51) Int. Cl.
*H01Q 1/38* (2006.01)
*H01Q 1/24* (2006.01)

(52) U.S. Cl. ..... 343/700 MS; 343/702; 343/846

(58) Field of Classification Search ..... None
See application file for complete search history.

(56) References Cited

U.S. PATENT DOCUMENTS

| | | | | |
|---|---|---|---|---|
| 6,950,065 | B2 * | 9/2005 | Ying et al. | 343/700 MS |
| 7,541,984 | B2 * | 6/2009 | Peng et al. | 343/700 MS |
| 7,728,783 | B2 * | 6/2010 | Su et al. | 343/846 |
| 7,868,831 | B2 * | 1/2011 | Hung et al. | 343/700 MS |
| 7,928,916 | B2 * | 4/2011 | Hung et al. | 343/702 |
| 8,284,106 | B2 * | 10/2012 | Guan | 343/700 MS |
| 2004/0090377 | A1 * | 5/2004 | Dai et al. | 343/700 MS |
| 2011/0032170 | A1 * | 2/2011 | Chiang et al. | 343/860 |

* cited by examiner

*Primary Examiner* — Trinh Dinh
(74) *Attorney, Agent, or Firm* — Berenato & White, LLC

(57) ABSTRACT

An antenna device includes a substrate, and a dual-band antenna disposed on a surface of the substrate. The dual-band antenna includes a feed-in section, a first radiator arm, a second radiator arm, a third radiator arm, and a ground section. The feed-in section is for signal feed-in, and has opposite first and second ends. The first radiator arm extends from the first end of the feed-in section and is parallel to the feed-in section. The second radiator arm is connected to the second end of the feed-in section and extends parallel to the feed-in section. The third radiator arm is disposed adjacent to and extends parallel to the first radiator arm in a manner that the feed-in section is disposed between the third radiator arm and the second radiator arm. The ground section is connected to the third radiator arm.

13 Claims, 8 Drawing Sheets

ANTENNA DEVICE AND DUAL-BAND ANTENNA

CROSS-REFERENCE TO RELATED APPLICATION

This application claims priority of Taiwanese Application No. 098134112, filed on Oct. 8, 2009.

BACKGROUND OF THE INVENTION

1. Field of the Invention

The present invention relates to an antenna device, more particularly to an antenna device having a dual-band antenna.

2. Description of the Related Art

In recent years, popularity of the Internet accelerated development of Wireless Wide Area Networks (WWAN) for city-to-city or even country-to-country mobile access. WWAN use several frequency bands, two of which have frequencies ranging from 824 MHz to 960 MHz and from 1710 MHz to 2170 MHz, respectively. Accordingly, most modern portable computers, such as laptop computers, notebook computers, and netbook computers are equipped with an antenna device for access to WWAN.

It is known that size, weight, and thickness of portable computers have to be carefully designed so as to avoid compromising mobility. Hence, conventional monopole antennas, spiral antennas, and loop antennas are becoming less suitable for use in modern portable computers due to their dimensions. Referring to FIG. 1, a planar inverted-F antenna 9 for portable computers has been proposed to overcome this issue. Nevertheless, the planar inverted-F antenna 9 is known to have narrow bandwidth, low efficiency, and directional antenna radiation pattern.

SUMMARY OF THE INVENTION

Therefore, an object of the present invention is to provide an antenna device with that occupies relatively small space.

Another object of the present invention is to provide an antenna device with improved efficiency in a low-frequency band.

According, an antenna device of the present invention includes a substrate having a surface, and a dual-band antenna disposed on the surface of the substrate. The dual-band antenna includes a feed-in section, a first radiator arm, a second radiator arm, a third radiator arm, and a ground section. The feed-in section is elongated, is used for signal feed-in, and has opposite first and second ends. The first radiator arm extends from the first end of the feed-in section and is parallel to the feed-in section. The second radiator arm is connected to the second end of the feed-in section and extends parallel to the feed-in section. The third radiator arm is disposed adjacent to and extends parallel to the first radiator arm in a manner that the feed-in section is disposed between the third radiator arm and the second radiator arm. The ground section is connected to the third radiator arm.

Preferably, the first radiator arm is disposed between the feed-in section and the third radiator arm.

Preferably, the first end of the feed-in section is configured as a feed-in portion for signal feed-in.

Preferably, electrical length of the third radiator arm is greater than that of the first radiator arm, and is greater than an overall electrical length of the second radiator arm and the feed-in section.

Preferably, overall electrical length of the second radiator arm and the feed-in section is greater than the electrical length of the first radiator arm.

Preferably, third radiator arm has a length longer than that of the first radiator arm and that of the second radiator arm, and projection of each of the first and second radiator arms onto the third radiator arm does not extend beyond opposite ends of the third radiator arm.

Preferably, the ground section extends parallel to the second radiator arm, and the second radiator arm is disposed between the feed-in section and the ground section.

Preferably, the substrate has opposite first and second side edges, the third radiator arm is disposed adjacent to the first side edge, and the ground section is disposed adjacent to the second side edge.

The third radiator arm of the dual-band antenna of the antenna device is suitable for transceiving in a low-frequency band. Bandwidth of the dual-band antenna in the low-frequency band is improved through cooperation of the second radiator arm and the feed-in section. Further, dimensions of the antenna device are reduced through the configuration of the third radiator arm and the ground section in relation to the peripheral edges of the substrate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
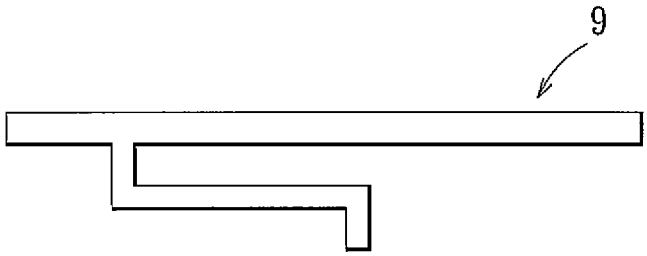
FIG. 1 PRIOR ART
FIG. 1 is a schematic diagram illustrating a conventional planar inverted-F antenna.
Figure 2:
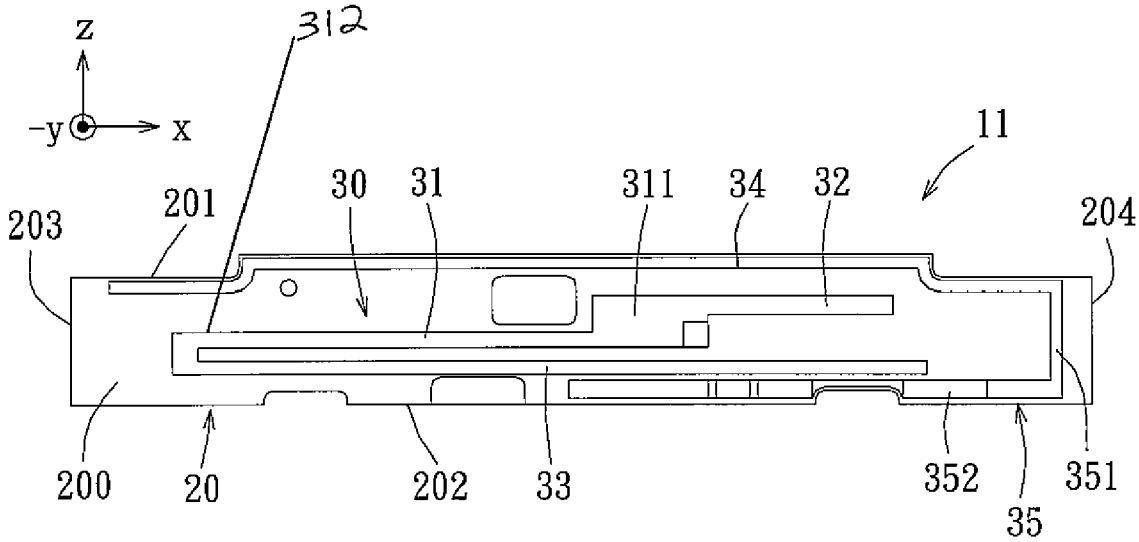
FIG. 2 is a schematic diagram illustrating the preferred embodiment of an antenna device according to the present invention.

Referring to FIG. 2, the preferred embodiment of an antenna device 11 according to the present invention is suitable for installation in an electronic device, such as a portable computer. The antenna device 11 includes a substrate 20 and a dual-band antenna 30. The substrate 20 is rectangular and has a surface 200, a first peripheral edge 201, a second peripheral edge 202, a third peripheral edge 203, and a fourth peripheral edge 204. The dual-band antenna 30 is disposed on the surface 200 of the substrate 20, and includes a feed-in section 31, a first radiator arm 32, a second radiator arm 33, a third radiator arm 34, and a ground section 35. In this embodiment, the substrate 20 is formed with a plurality of holes for securing in the electronic device without compromising functionality of the antenna device 11.

The feed-in section 31 extends parallel to the first peripheral edge 201, and has a first end and an opposite second end 312. The first end of the feed-in section 31 is configured as a feed-in portion 311 for signal feed-in.

The first radiator arm 32 extends from the feed-in portion 311 of the feed-in section 31 toward the fourth peripheral edge 204, extends parallel to the feed-in section 31, and is closer to the first peripheral edge 201 compared to the feed-in section 31.

The second radiator arm 33 forms a junction with the second end of the feed-in section 31, extends therefrom toward the fourth peripheral edge 204, extends parallel to the feed-in section 31, and is closer to the second peripheral edge 202 compared to the feed-in section 31.

The third radiator arm 34 is disposed between the first radiator arm 32 and the first peripheral edge 201, is adjacent to the first peripheral edge 201, and extends along the first peripheral edge 201. The third radiator arm 34 has opposite first and second ends proximate to the third and fourth peripheral edges 203, 204, respectively.

The ground section 35 has a first portion 351 and a second portion 352. The first portion 351 is disposed adjacent to the fourth peripheral edge 204, has a first end connected to the first end of the third radiator arm 34, and extends perpendicularly with respect to the third radiator arm 34 toward the second peripheral edge 202. The second portion 352 extends from a second end of the first portion 351, parallel to the second radiator arm 33, and toward the third peripheral edge 203. The second portion is disposed adjacent to the second peripheral edge 202. Hence, the second radiator arm 33 is disposed between the feed-in section 31 and the second portion 352 of the ground section 35. In the present embodiment, the second portion 352 of the ground section is provided with a copper foil (not shown) for connection to a ground plane of the electronic device.

Overall, the feed-in section 31 is disposed between the second and third radiator arms 33, 34. The first radiator arm 32 is closer to the first and fourth peripheral edges 201, 204, and is adjacent to the third radiator arm 34. That is to say, the third radiator arm 34, the first radiator arm 32, the feed-in section 31, the second radiator arm 33, and the second portion 352 of the ground section 35 are parallel to and spaced apart from an adjacent one in the given order. Furthermore, length of the third radiator arm 34 is longer compared to those of the first and second radiator arms 32, 33. Projection of each of the first and second radiator arms 32, 33 onto the third radiator arm 34 does not extend beyond the first and second ends of the third radiator arm 34. Moreover, when the feed-in portion 311 receives a feed-in signal, the signal is coupled to the third radiator arm 34 through the arrangement where the first and third radiator arms 32, 34 are parallel to and adjacent to each other.

Figure 3:
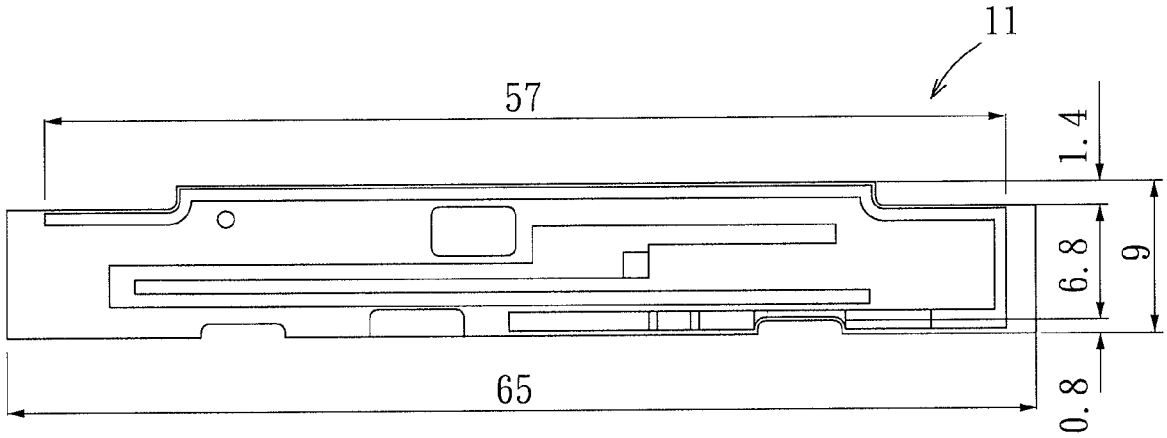
FIG. 3 is a schematic diagram illustrating dimensions of the antenna device and a dual-band antenna thereof.

FIG. 3 is a schematic diagram to illustrate dimensions of the antenna device 11 and the dual-band antenna 30 in millimeters.

It is to be noted that the dual-band antenna 30 is operable in Wireless Wide Area Networks (WWAN), which generally operate at frequencies ranging from 824 MHz to 960 MHz and from 1710 MHz to 2170 MHz. The first radiator arm 32 of the dual-band antenna 30 has a shorter electrical length, and is for transceiving electromagnetic signals at frequencies ranging from 1710 MHz to 2170 MHz. On the other hand, the third radiator arm 34 of the dual-band antenna 30 has a longer electrical length, and is for transceiving at frequencies ranging from 824 MHz to 960 MHz. The electrical length of the third radiator arm 34 is greater than that of the first radiator arm 32 and is greater than an overall electrical length of the second radiator arm 33 and the feed-in section 31. Further, the feed-in section 31 and the second radiator arm 33 are designed to have a feed-in mechanism similar to that of a monopole antenna such that the overall electrical length of the second radiator arm 33 and the feed-in section 31 is greater than electrical length of the first radiator arm 32. Thus, the dual-band antenna 30 has a wider operating bandwidth at lower frequencies.

Figure 4:
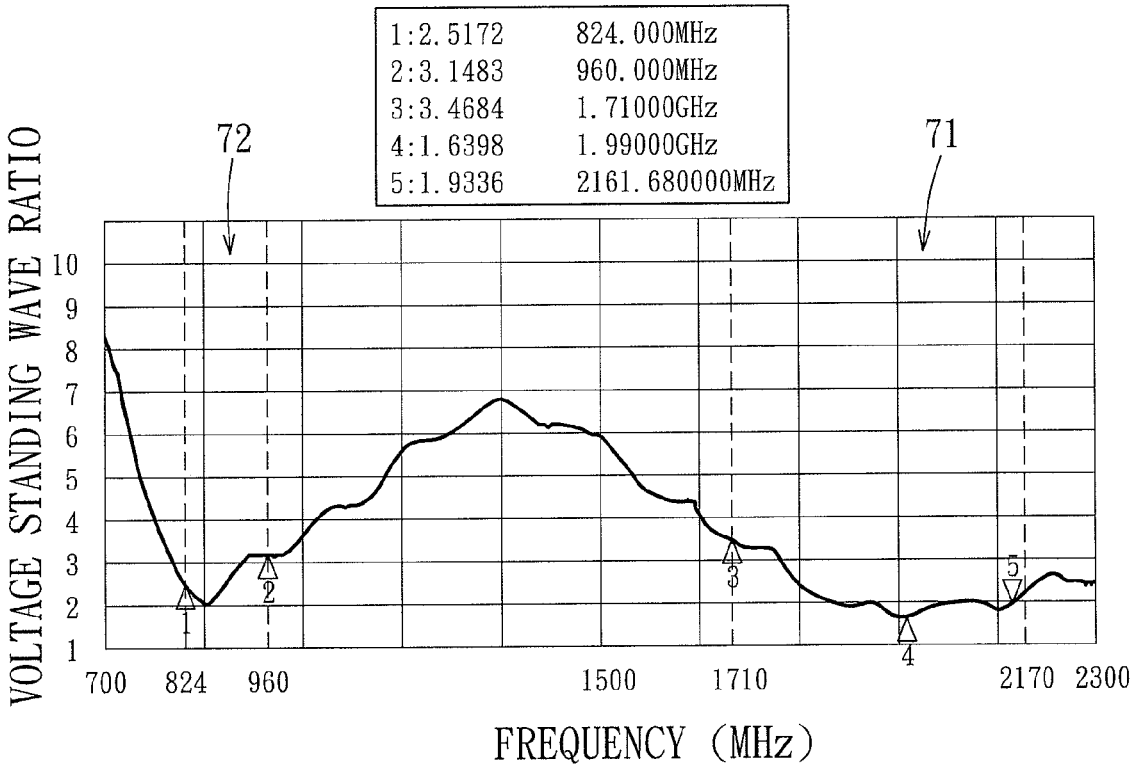
FIG. 4 is a Voltage Standing Wave Ratio (VSWR) plot showing VSWR values of the antenna device within the WWAN frequency range.
Figure 5:
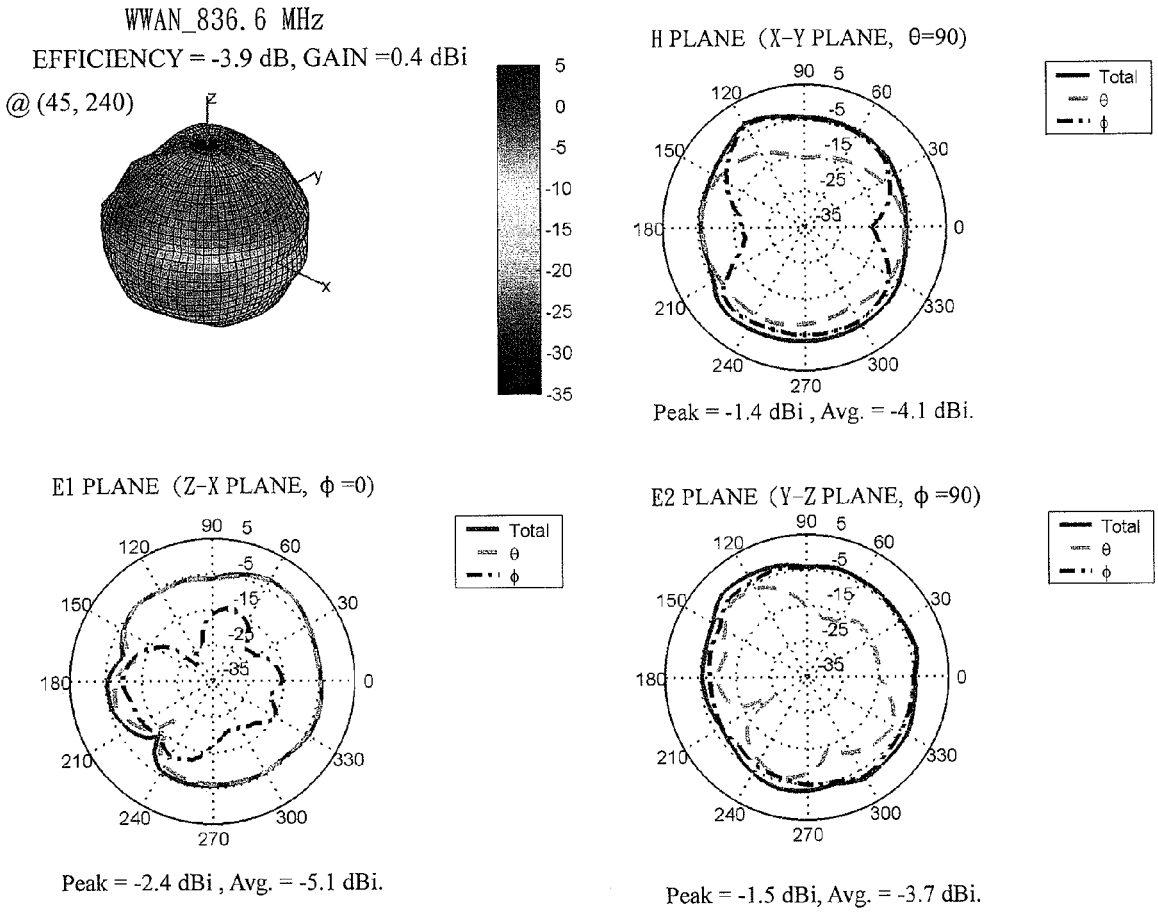
FIG. 5 is a three-dimensional radiation pattern diagram of the antenna device operating at 836.6 MHz, the radiation pattern being further viewed on the X-Y, X-Z, and Y-Z planes.
Figure 6:
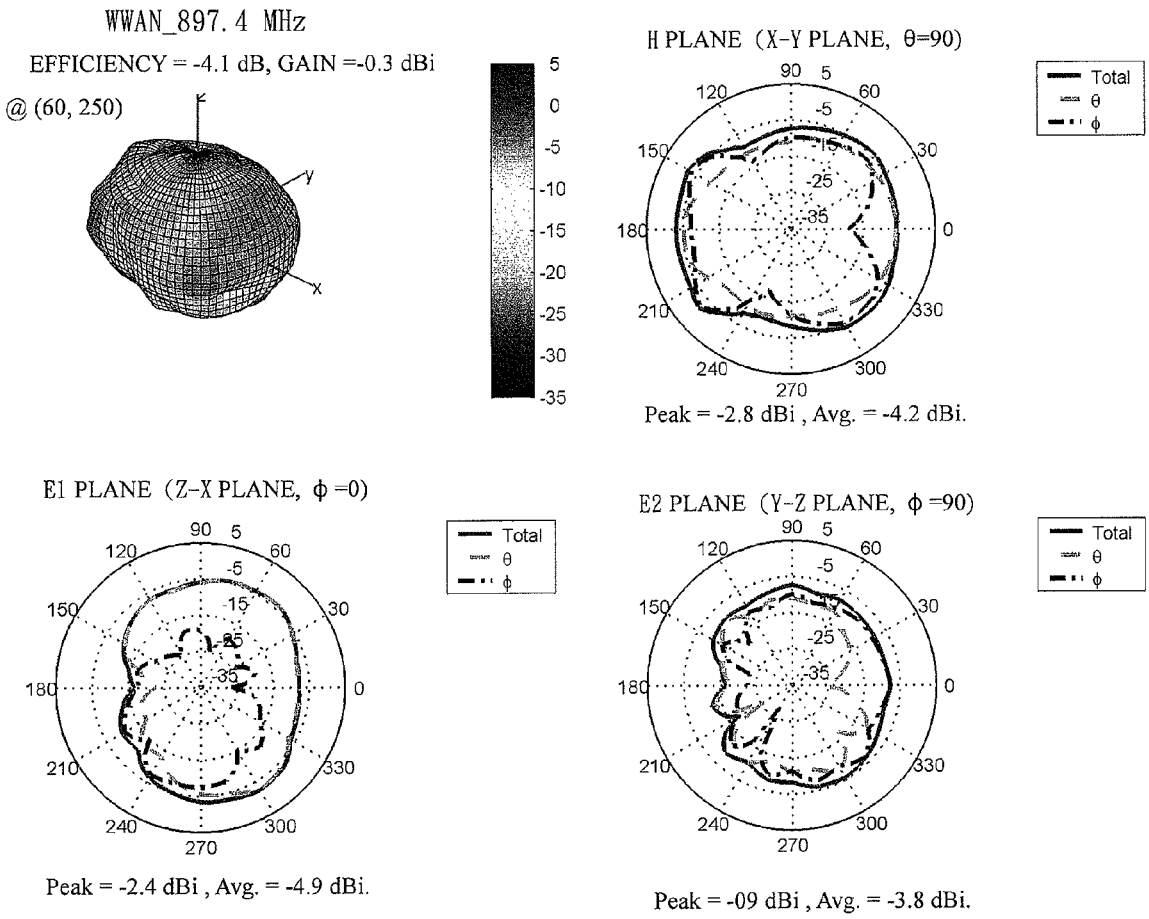
FIG. 6 is a three-dimensional radiation pattern diagram of the antenna device operating at 897.4 MHz, the radiation pattern being further viewed on the X-Y, X-Z, and Y-Z planes.
Figure 7:
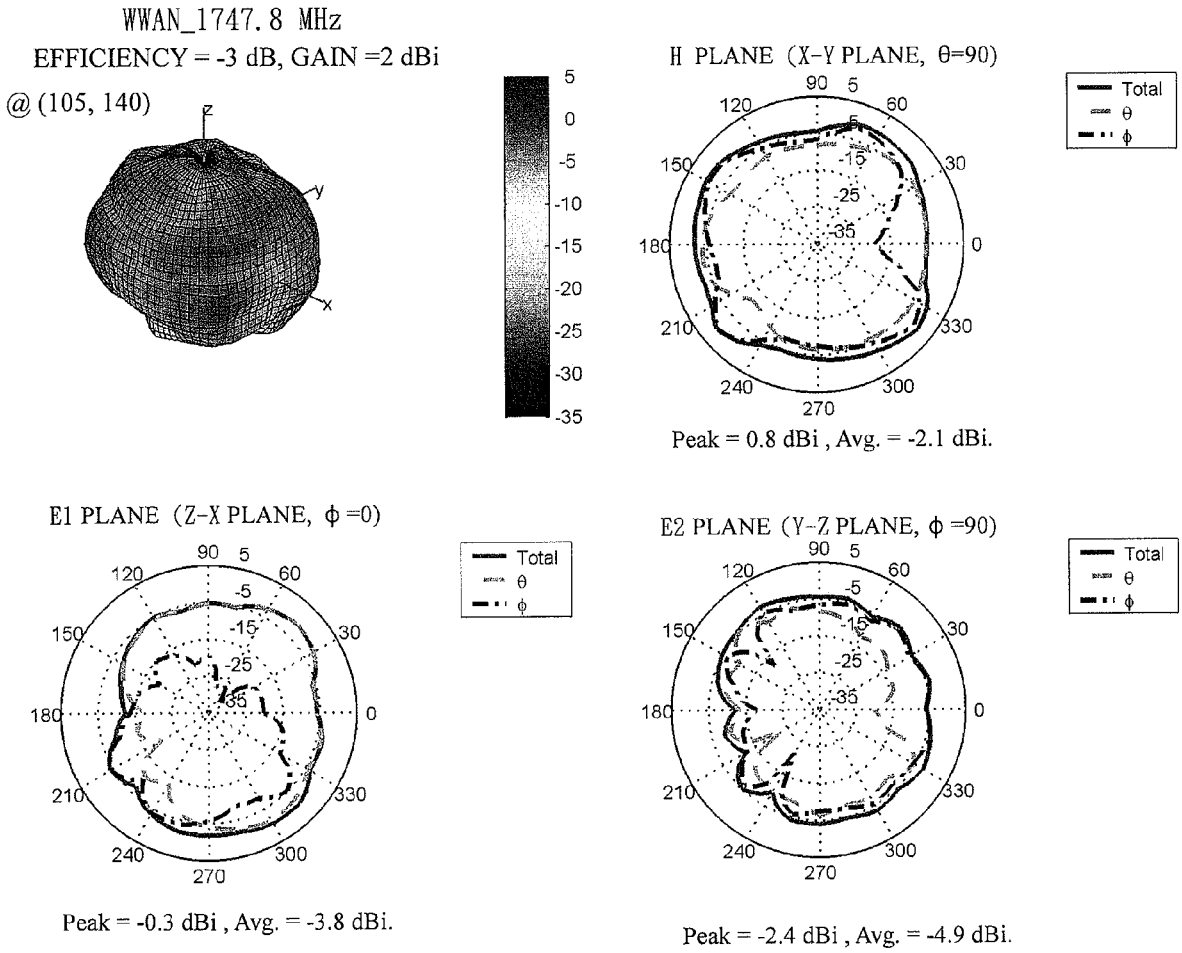
FIG. 7 is a three-dimensional radiation pattern diagram of the antenna device operating at 1747.8 MHz, the radiation pattern being further viewed on the X-Y, X-Z, and Y-Z planes.
Figure 8:
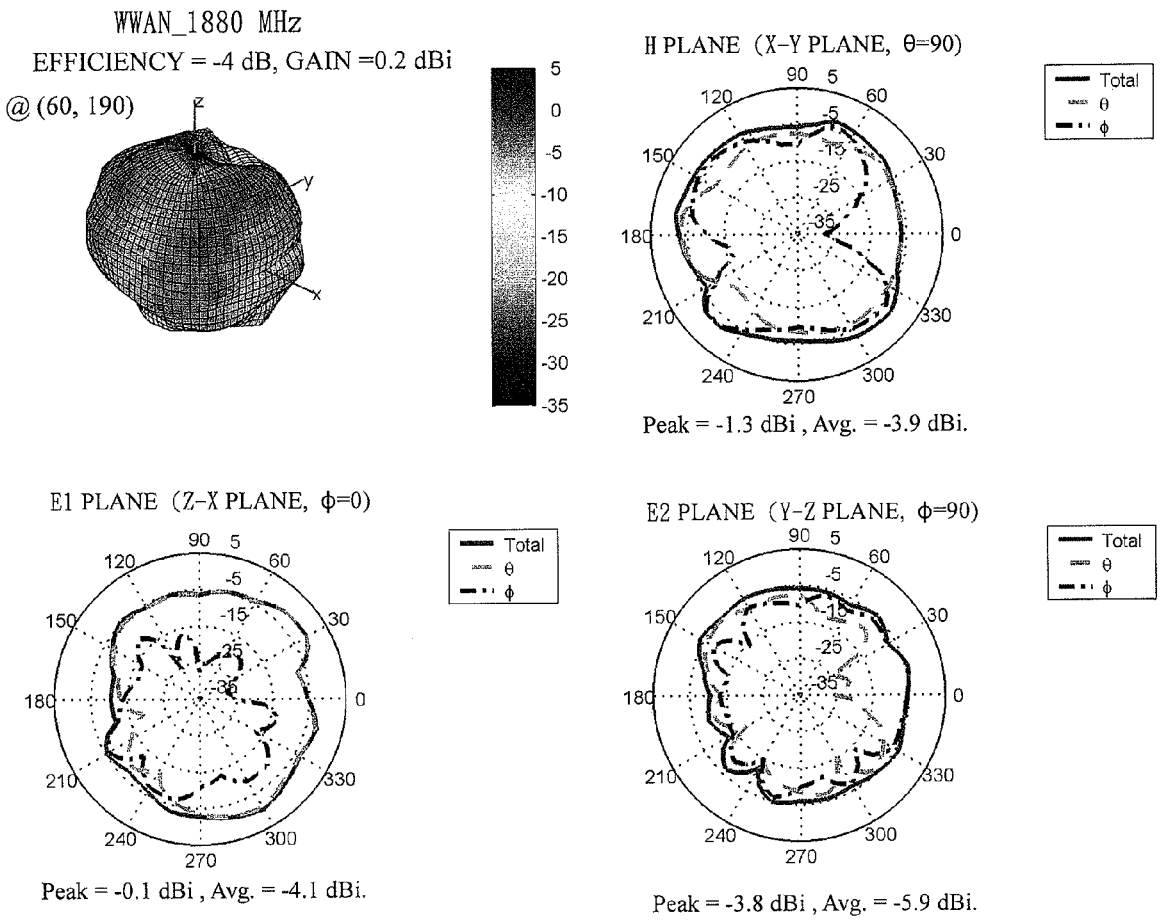
FIG. 8 is a three-dimensional radiation pattern diagram of the antenna device operating at 1880 MHz, the radiation pattern being further viewed on the X-Y, X-Z, and Y-Z planes.
Figure 9:
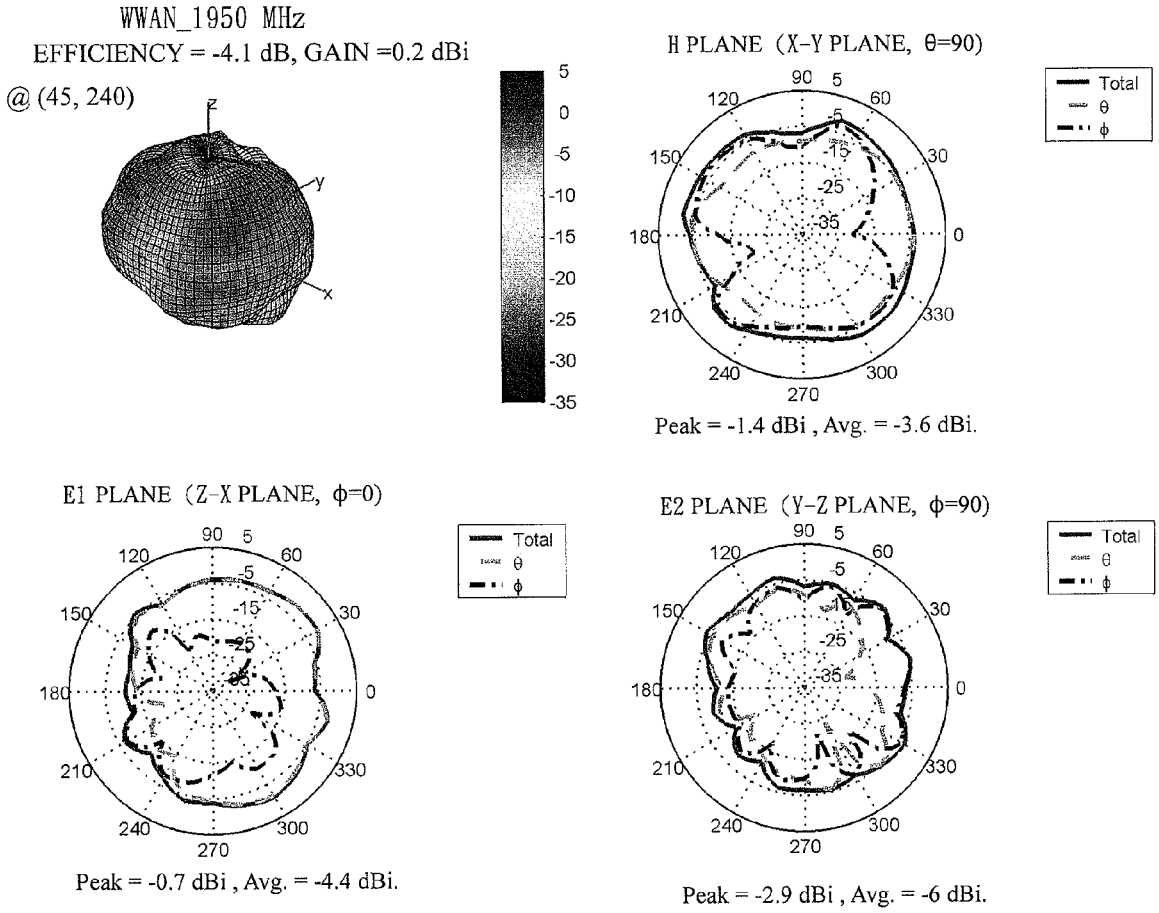
FIG. 9 is a three-dimensional radiation pattern diagram of the antenna device operating at 1950 MHz, the radiation pattern being further viewed on the X-Y, X-Z, and Y-Z planes.

Referring to FIG. 4, a Voltage Standing Wave Ratio (VSWR) plot indicates that the VSWR values of the antenna device 11 at all frequencies in a high-frequency band 71 (i.e., the aforesaid 1710 MHz to 2170 MHz band) and a low-frequency band 72 (i.e., the aforesaid 824 MHz to 960 MHz band) do not exceed 3.5. Therefore, the first and third radiator arms 32, 34 are suitable for transceiving in the high- and low-frequency resonant bands 71, 72.

FIGS. 5 to 9 show radiation patterns of the antenna device 11 at frequencies of 836.6 MHz, 897.4 MHz, 1747.8 MHz, 1880 MHz, and 1950 MHz, respectively, and different intensities of darkness correspond to different values of gain. Moreover, electrical fields and magnetic fields of the radiation patterns are further presented on the X-Y, Z-X, and Y-Z planes. Gain of the antenna device 11 is measured in dBi (decibel isotropic). In each of the plane diagrams of the radiation patterns, the lighter dashed-line represents the electric field (phi), the darker dashed-line represents the magnetic field (theta), and the solid line represents the total of the electrical field and magnetic field. It can be noted from FIGS. 5 to 9 that radiation patterns of the antenna device 11 are substantially omni-directional.

Figure 10:
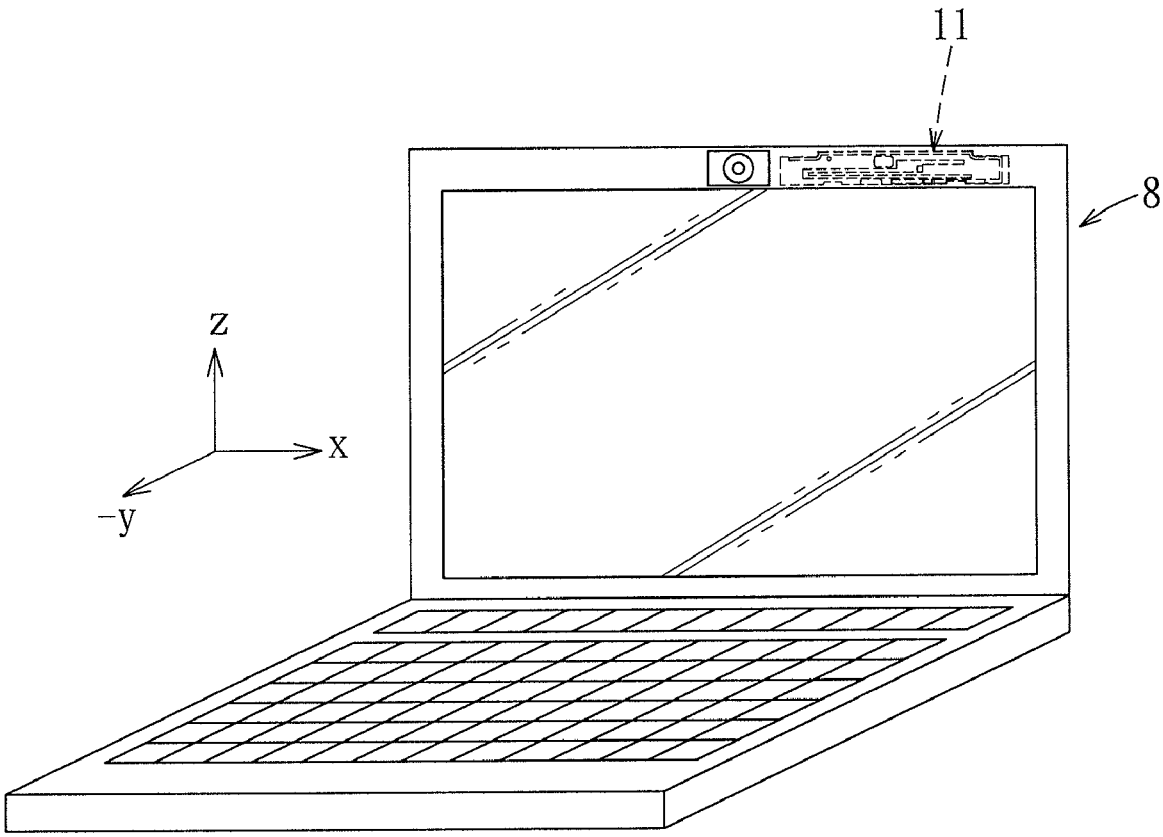
FIG. 10 is a perspective view illustrating a portable computer installed with the antenna device.

In FIG. 10, the antenna device 10 is installed at a top margin of a monitor of a portable computer 8. It is to be noted that occupied space of the substrate 20 is reduced through disposing the third radiator arm 34 adjacent to the first peripheral edge 201, the ground section 35 adjacent to the second and fourth peripheral edges 202, 204, and the second end of the third radiator arm 34 adjacent to the third peripheral edge 203.

In summary, the third radiator arm 34 of the dual-band antenna 30 of the antenna device 11 of this invention is suitable for transceiving in the low-frequency band 72. Bandwidth of the dual-band antenna 30 in the low-frequency band 72 is improved through cooperation of the second radiator arm 33 and the feed-in section 31. Further, occupied space of the antenna device 11 is reduced through the configuration of the third radiator arm 34 and the ground section 35 in relation to the first, second, third, and fourth peripheral edges 201, 202, 203, 204 of the substrate 20.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A dual-band antenna for disposing on a substrate, said dual-band antenna comprising:

an elongated feed-in section for signal feed-in, said feed-in section having opposite first and second ends;

a first radiator arm extending from said first end of said feed-in section and parallel to said feed-in section;

a second radiator arm connected to said second end of said feed-in section and extending parallel to said feed-in section;

a third radiator arm disposed adjacent to and extending parallel to said first radiator arm in a manner that said feed-in section is disposed between said third radiator arm and said second radiator arm; and a ground section connected to said third radiator arm, wherein said first radiator arm is disposed between said feed-in section and said third radiator arm.

2. The dual-band antenna as claimed in claim 1, wherein said first end of said feed-in section is configured as a feed-in portion for signal feed-in.

3. The dual-band antenna as claimed in claim 2, wherein electrical length of said third radiator arm is greater than that of said first radiator arm, and is greater than an overall electrical length of said second radiator arm and said feed-in section.

4. The dual-band antenna as claimed in claim 3, wherein the overall electrical length of said second radiator arm and said feed-in section is greater than the electrical length of said first radiator arm.

5. The dual-band antenna as claimed in claim 4, wherein said third radiator arm has a length longer than that of said first radiator arm and that of said second radiator arm, and projection of each of said first and second radiator arms onto said third radiator arm does not extend beyond opposite ends of said third radiator arm.

6. The dual-band antenna as claimed in claim 5, wherein said ground section extends parallel to said second radiator arm, and said second radiator arm is disposed between said feed-in section and said ground section.

7. An antenna device for installation in an electronic device, said antenna device comprising:

a substrate having a surface; and a dual-band antenna disposed on said surface of said substrate and including an elongated feed-in section for signal feed-in, said feed-in section having opposite first and second ends, a first radiator arm extending from said first end of said feed-in section and parallel to said feed-in section, a second radiator arm connected to said second end of said feed-in section and extending parallel to said feed-in section, a third radiator arm disposed adjacent to and extending parallel to said first radiator arm such that said feed-in section is disposed between said third radiator arm and said second radiator arm, and a ground section connected to said third radiator arm, wherein said first radiator arm is disposed between said feed-in section and said third radiator arm.

8. The antenna device as claimed in claim 7, wherein said first end of said feed-in section is configured as a feed-in portion for signal feed-in.

9. The antenna device as claimed in claim 8, wherein electrical length of said third radiator arm is greater than that of said first radiator arm, and is greater than an overall electrical length of said second radiator arm and said feed-in section.

10. The antenna device as claimed in claim 9, wherein the overall electrical length of said second radiator arm and said feed-in section is greater than the electrical length of said first radiator arm.

11. The antenna device as claimed in claim 10, wherein said third radiator arm has a length longer than that of said first radiator arm and that of said second radiator arm, and projection of each of said first and second radiator arms onto said third radiator arm does not extend beyond opposite ends of said third radiator arm.

12. The antenna device as claimed in claim 11, wherein said ground section extends parallel to said second radiator arm, and said second radiator arm is disposed between said feed-in section and said ground section.

13. The antenna device as claimed in claim 7, wherein said substrate has opposite first and second side edges, said third radiator arm being disposed adjacent to said first side edge, said ground section being disposed adjacent to said second side edge.

* * * * *